United States Patent [19]

Woller

[11] Patent Number: 4,930,173

[45] Date of Patent: Jun. 5, 1990

[54] CUSHION ELEMENT AND METHOD FOR MAKING SAME

[75] Inventor: Thomas A. Woller, Jamestown, N.C.

[73] Assignee: Baker, Knapp & Tubbs, Inc., Chicago, Ill.

[21] Appl. No.: 374,888

[22] Filed: Jul. 3, 1989

[51] Int. Cl.[5] ..... A47C 27/14

[52] U.S. Cl. ..... 5/481; 297/452; 297/DIG. 1

[58] Field of Search ..... 5/481, 434, 436, 448; 297/452, DIG. 1

[56] References Cited

U.S. PATENT DOCUMENTS

| | | | |
|---|---|---|---|
| 2,231,346 | 2/1941 | Riesing et al. | 247/DIG. 1 |
| 2,315,391 | 3/1943 | Blair | 5/434 |
| 2,775,998 | 1/1957 | Osborn . | |
| 2,835,313 | 5/1958 | Dodge | 5/481 |
| 2,858,881 | 11/1958 | Newall et al. | 5/481 |
| 3,178,735 | 4/1965 | Thompson et al. . | |
| 3,283,346 | 11/1966 | Marsh et al. | 5/481 |
| 3,287,750 | 11/1966 | Jessup . | |
| 3,462,779 | 8/1969 | Thompson . | |
| 4,190,697 | 2/1980 | Ahrens | 428/315 |
| 4,405,681 | 9/1983 | McEvoy | 428/316.6 |

FOREIGN PATENT DOCUMENTS

| | | | |
|---|---|---|---|
| 654561 | 6/1963 | Italy | 5/481 |

*Primary Examiner*—Alexander Grosz
*Attorney, Agent, or Firm*—Quarles & Brady

[57] ABSTRACT

An internal cushion element is constructed in the form of a box. It has a top wall, bottom wall, and side walls to define an internal cavity. A plurality of spaced vertical foam spacer slabs are positioned in the cavity extending from the front of the box to the back of the box, and from the bottom of the box to the top of the box. The strips are spaced apart in generally parallel rows. The relaxed state height of at least some of the strips is higher than that of the outside walls. Thus, the internal strips provide a crown to the cushion element. A convoluted foam patch is also provided on the outside of the cushion element.

5 Claims, 2 Drawing Sheets

FIG. 2a
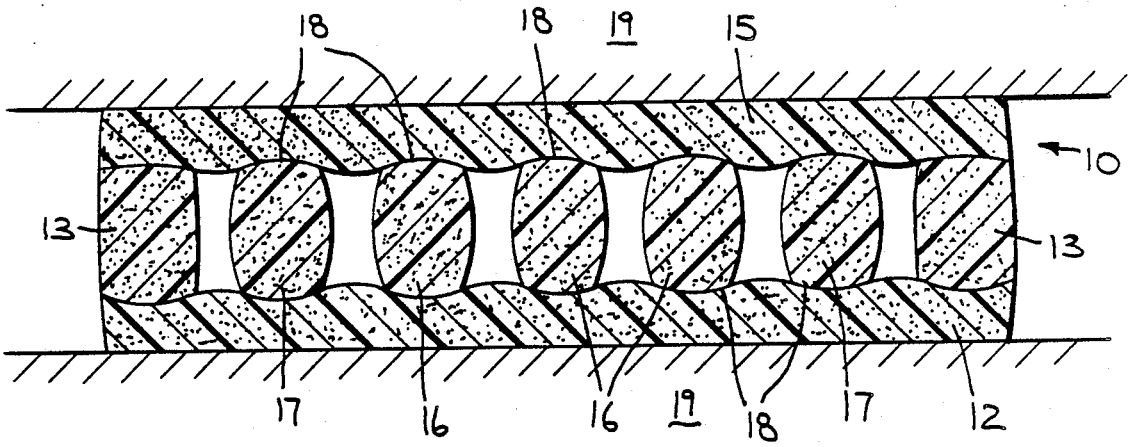
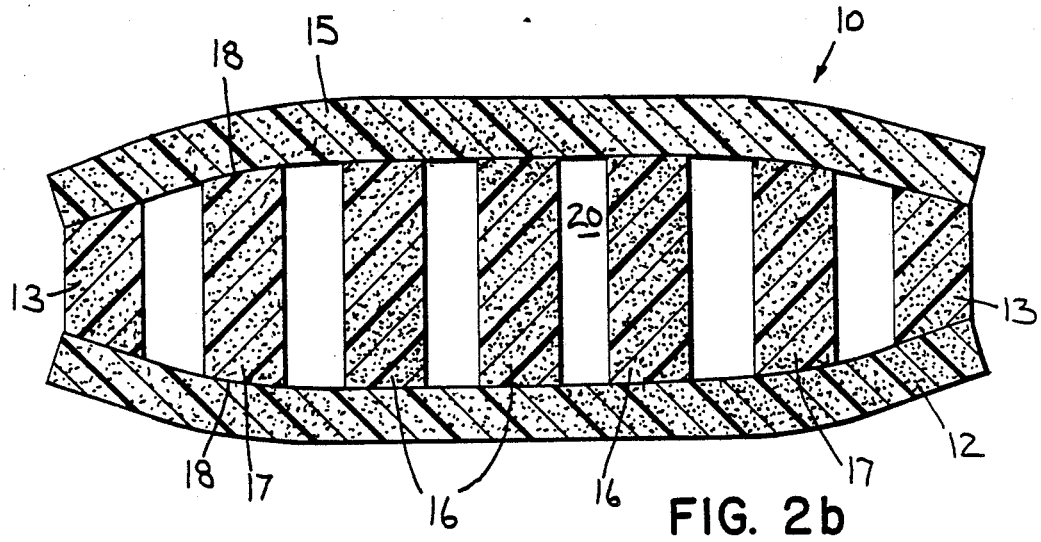
FIG. 2b

CUSHION ELEMENT AND METHOD FOR MAKING SAME

BACKGROUND OF THE INVENTION

1. Field Of The Invention

The invention relates to seat cushions. More particularly, it relates to multi-piece cushion elements that are constructed of polyurethane or other plastic foams.

2. Description Of The Art

The use of resilient polyurethane foam for seat cushion interiors is well known. However, a number of difficulties have been encountered in using such foams, chief among these being irregular I.L.D. compression of available molded foam, unacceptably short wear life of the cushion, and the unacceptable feel which such cushions give (e.g. due to skinning on molded foam and/or compression factors).

Some problems associated with using foam cushions have been overcome by cutting the cushion interior elements out of larger commercial size "buns". These buns are produced by allowing the polyurethane foam to freely expand to produce a lower I.L.D. compression foam near the upper part of the bun. After the outer most skin is trimmed off, the upper most portion of the bun is cut away and used for the cushion. This softer, skinless foam is much better for use as cushion material. However, it commands a premium price. Also, as its thickness increases, it begins to give the user more and more of the feel of sitting on an inflated basketball.

In recent years there has been a movement towards styling requiring extremely thick cushions that are highly "crowned". Aside from the problems discussed above with respect to feel and price, this causes a tendency for the cushion to wear less well under repeated compression (apparently due to the rubbing of the material against itself). Another problem is that cutting large foam blocks into thick crowned surfaces requires specially designed machines, and generates considerable waste materials.

Some time ago there were attempts to produce foam cushion elements that had spaced internal foam components (see U.S. Pat. Nos. 2,835,313 and 2,858,881). However, these prior art systems were not widely adopted, apparently due to the costs involved in providing the complex shapes or installing the components, the deficiencies in the available foam, the deficiencies in providing a suitable feel to the user, and other reasons. Thus, it can be seen that a need exists for a plastic foam cushion element that uses less foam than a solid block cushion element, is resistant to wear, has a high crown, feels to a user like a high quality cushion, and is inexpensive to produce.

SUMMARY OF THE INVENTION

The invention provides a cushion element which has a foam box that has a top wall, a bottom wall, and at least two opposed side walls. These walls define an internal cavity.

A plurality of support slabs are positioned in the cavity and extend between the opposed side walls. The slabs are in contact with both an inside surface of the bottom wall and an inside surface of the top wall, and are spaced from one another in at least part of the cavity.

At least one of the slabs has a greater relaxed state height than the relaxed state height of at least one of the side walls. The walls and slabs are juxtaposed such that at least one slab causes an outward crown in the cushion, preferably in both the cushion top wall and bottom wall. In an especially preferred form, a patch is fastened to an outer surface of the top and/or bottom wall to enhance the crown of the cushion. The patch is made of convoluted foam.

In another aspect of the invention, there is provided a method for constructing such a cushion element. One first forms a foam pan having a bottom wall and side walls, said walls defining an internal cavity. One then positions a plurality of foam support slabs in the cavity such that they extend between opposed side walls, are in contact with an upper surface of the bottom wall, and are spaced from one another in at least part of the cavity. One then affixes the top surfaces of the support layout slabs to a top cover wall, and also affixes the top cover wall to the top surface of at least one side wall. An adhesive is used to affix the side wall and slabs to the top cover wall. This forms a crowned cushion element.

One then compresses the cushion element before the adhesive has set to render the cushion element less crowned. Thereafter, one then removes the compressive force to allow the cushion element to spring into a crown shape after the adhesive has set.

It will be appreciated from the description above and below that the present invention provides a means of forming a foam box which is made out of essentially rectangular foam elements. By varying the density of the foam material, the thickness of the slabs, and/or the height of the slabs, one can achieve desired feel characteristics of a cushion using even relatively undesirable portions of commercial foam buns. Moreover, the unique method of manufacture overcomes the considerable problem of how to affix the top wall to the foam box when one uses vertical slab supports of different heights.

A person sitting on a cushion, used in a chair or the like, typically does not compress the top cover straight downward, but pushes the top cover slightly toward the back of the chair. In a seat constructed with the present cushion element, the foam slabs are orientated to run from front to back of the seat, and thus provide resistance to movement of the top cover backward and to prevent the foam slabs from folding over.

While the use of convoluted patches in connection with solid foam cushions has previously been known, such systems did not give the desired characteristics. Further, the use of the patches themselves did not give the desired feel characteristics. Surprisingly, when one combines the use of a convoluted patch together with the foam box of the present invention, one gets a cushion element which very closely approximate high quality cushions, yet retains important wear characteristics.

Thus, it can be seen that the objects of the present invention include:

(a) providing a cushion element of the above kind that uses less foam and permits the use of less expensive grades of foam;

(b) providing a cushion element of the above kind that is resistant to wear;

(c) providing a cushion element of the above kind that has a high crown yet still feels like a high quality cushion to the user;

(d) providing a cushion element of the above kind that is inexpensive to produce; and (e) provided a method for making the cushion element of the above kind which permits the parts to be inexpensively attached to each other.

These and still other objects and advantages of the present invention will be apparent from the description which follows. In the following description, reference will be made to the accompanying drawings which form a part hereof and in which there is shown by way of illustration a preferred embodiment of the invention. Such embodiment does not necessarily represent the full scope of the invention, and reference therefore should be made to the claims herein for interpreting the full scope of the invention.

BRIEF DESCRIPTION OF THE DRAWINGS

FIG. 2(*a*) is a vertical sectional view of the completed box element of the present invention, with the view taken during the gluing step of manufacture (e.g. with compression plates shown above and below the box);

FIG. 2(*b*) is a view similar to that shown in FIG. 2(*a*), albeit with the compression plates removed.

DESCRIPTION OF THE PREFERRED EMBODIMENTS

Figure 1:
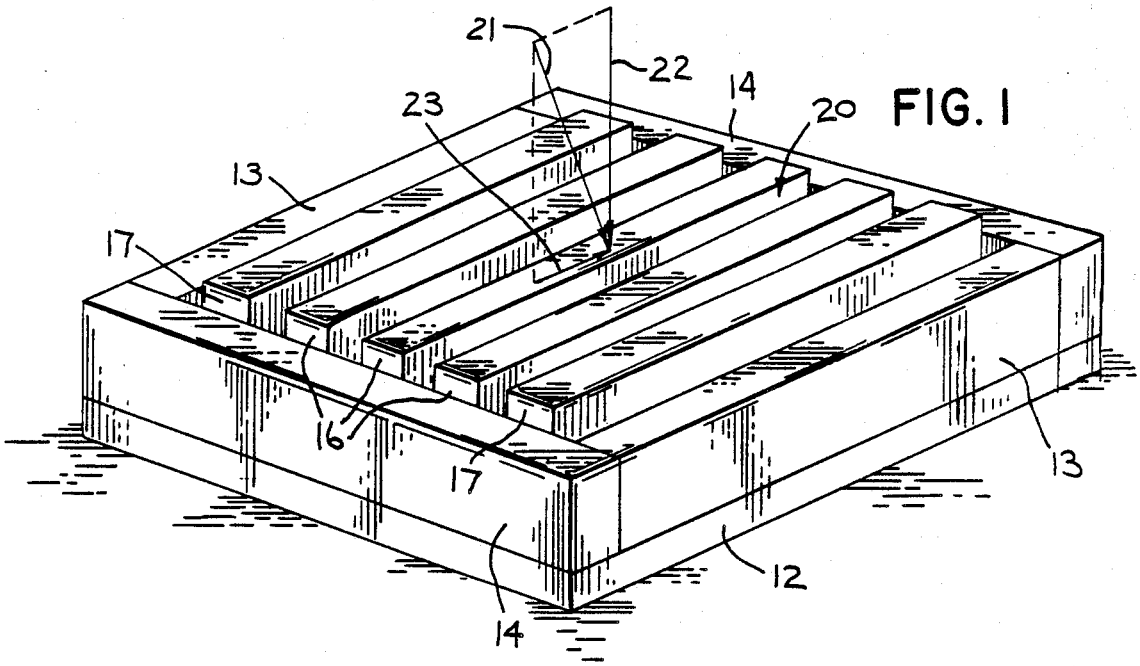
FIG. 1 is a perspective view of the box unit of the present invention, with the top cover removed.

Referring to FIGS. 1 and 2, the box unit 10 of the present invention has a generally rectangular bottom foam sheet 12. All of the foam components in the box are preferably made of polyurethane foam. The preferred foam has a density of 1.8 lbs/ft$^2$ and a I.L.D. rating of 20. Glued to the upper surface of this bottom wall 12, around its periphery, are opposed side walls 13 and 14. Top cover 15 is provided. While the box shown in the drawing is square in top view, rectangular or somewhat more circular boxes can also be formed.

The bottom sheet 12 and side walls 13, 14 form an upwardly open pan in which a plurality of vertical foam spacer strips or slabs 16 and 17 are glued. The inward and central strips have been designated 16 and the outward strips have been designated 17 for easy reference. If desired, all of these strips can be of the same size. In the alternative, strips 17 can have slightly greater height (depending on the crown desired). In any event, it will be appreciated that strips 16 and 17 are of a greater height than side walls 13 and 14.

The strips 16 and 17 extend front to back along the bottom of the foam sheet, in generally parallel fashion. They are glued in with an appropriate plastic adhesive 18 to all walls. The preferred adhesive is a synthetic rubber dissolved in a solvent, as is known in the art for joining polyurethane foams. Gaps 20 are provided between the slabs 16, 17 so that during normal compression the individual slabs never touch each other. The distance between the slabs can be uniform, or can be different within a cushion or between cushions.

It will be appreciated that the heights shown in FIG. 1 show the slabs in their uncompressed (relaxed) height. When they are compressed as shown in FIG. 2, the height of the slabs will obviously change. For a typical box 10, the middle vertical space strip 16 and 17 will typically be about 2" taller than the parallel side walls 13 when both are in the relaxed state. It will also be appreciated that all of the components described thus far are rectangular pieces which can easily be cut from commercially available polyurethane foam buns with a band saw.

In accordance with the method portion of the invention, after application of adhesive 18, the top foam sheet 15 is placed on top of the top surfaces of the slabs 16 and 17 and the side walls 13 and 14. The top wall is then pressed down against these top surfaces by the use of two parallel compression plates 19 before the adhesive sets. The compression is continued until the compressed height of the strips 16, 17 are equal to slightly less than the relaxed height of the side walls 13 and 14. This permits the adhesive 18 to set firmly to both the slabs and also the side walls.

As shown in FIG. 2(*b*), when the compression plates 19 are removed, sheets 15 and 12 spring outward into a crowned shape. This is due to the greater height of the strips 16 and 17.

Figure 3:
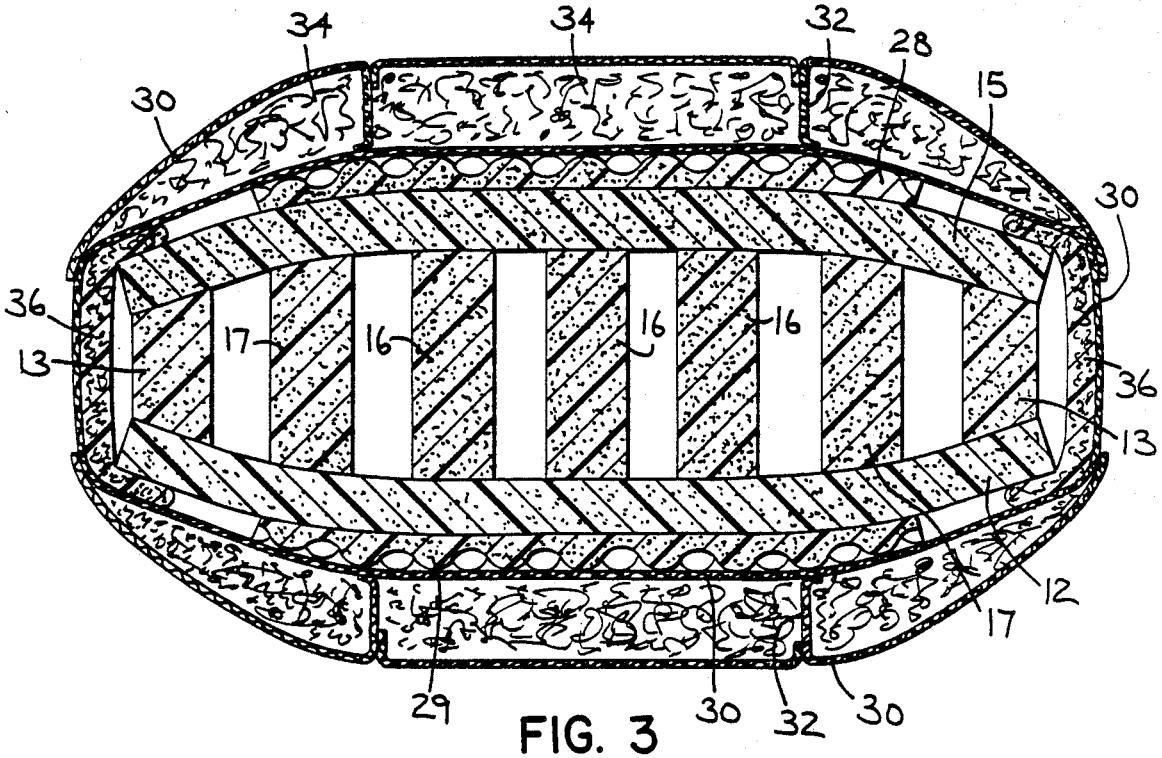
FIG. 3 is a sectional view similar to that of FIG. 2(*b*), showing the completed cushion (with crown patches, ticking, and risers).

Referring to FIG. 3, "convoluted" foam crown patches 28, 29 (each of which covers about 80% of the surface to which it is applied) is glued to the outer surfaces of the top and bottom walls. The convoluted foam is one inch thick with a density of 1 lb/ft$^2$ and an I.L.D. rating of 10. Convoluted foam of this type is readily available on a commercial basis. It may be cut without waste from a single foam sheet stretched by knobbed rollers prior to cutting. It is preferable to use the flat side of the convoluted foam against the top and bottom walls and have the convoluted surface extend in the outward direction.

A batting 36 of non-woven, $\frac{3}{4}$ ounce per square foot heat-set bonded polyester fiber can then be wrapped around four side walls of the box 10 to cover and pad the seams between the side walls 13, 14 and the top and bottom walls 12, 15. The assembly can then be placed in a double layer bag of down proof ticking 30 that is joined together by soft ticking risers 32 to form discrete channels that are filled with down, feathers, polyester fiber, or any combination thereof 34. The completed cushion 27 is then ready for upholstering.

When the cushion is used in a couch or chair, the direction of the parallel rows of vertical foam spacer strips 16 and 17 is oriented to run from the front to the back of the couch or chair. Referring again to FIG. 1, the principal axis of compression 21 of a cushion in such an application is not perpendicular to the top surface of the cushion. Instead, it is tipped towards the front of the chair or couch by approximately 7°. This axis of compression 21 resolves itself into a normal force 22 and a shear force 23. The later shear force 23 is essentially parallel to the face of the cushion and directed toward the back of the couch or chair. The orientation of the vertical foam spacer strips 16 and 17 therefore serves to resist the shear force, providing additional stiffness in the shear direction. Thus, the problem of having the slabs fold over on one another as a user sits down, with resulting wear, is avoided.

Apart from the improvement in comfort, the invention substantially increases the wear life of the cushion obtained, as compared to solid foam construction. It is believed that this is due to the fact that the separate foam spacer strips 18 reduce internal friction between adjacent elements of foam when the cushion is compressed. These results are achieved while still achieving the desired crown feel.

A preferred embodiment of the invention has been described. However, it should be apparent to those skilled in the art that many variations can be made without departing from the spirit of the invention. For example, the density of the foam used could be varied from strip to strip to control the softness of the cushion. Also, while polyurethane foam is the preferred material, other plastic foams may also be useful.

I claim:

1. An outwardly crowned cushion element adapted to be the support surface of a chair or the like, thereby supporting a seated user, comprising:

a foam box having a top wall, a bottom wall, and two opposed generally parallel side walls of substantially equal height, and further side walls, which together with said two opposed side walls form a substantially closed foam perimeter, said walls defining an internal cavity;

a plurality of elongate foam support slabs positioned in the cavity and extending between and generally parallel with the opposed side walls, said slabs being in contact with both an inside surface of the bottom wall and an inside surface of the top wall;

said slabs also being spaced sufficiently from one other in at least part of the cavity so that they remain separated from one another under normal compression caused by a seated user; and at least one of the slabs in a central area of the cavity having a greater relaxed state height than the relaxed state height of said two opposed side walls, wherein the walls and slabs are juxtaposed such that at least one slab causes an outward crowning in the cushion element.

2. The cushion element of claim 1, further comprising a convoluted foam patch fastened to the outer surface of at least one of said top and bottom walls to enhance the crown of the cushion element.

3. The cushion element of claim 2, wherein the foam is plastic foam.

4. The cushion element of claim 2, wherein the foam is polyurethane foam.

5. A chair or the like, including a crowned cushioned element adapted to support a seated riser, comprising:

a foam box having a top wall, a bottom wall, and two opposed generally parallel side walls of substantially equal height, and further side walls, which together with said two opposed side walls form a substantially closed foam perimeter, said walls defining an internal cavity;

a plurality of elongate foam support slabs positioned in the cavity extending between and generally parallel with the opposed side walls, said slabs being in contact with both an inside surface of the bottom wall and an inside surface of the top wall;

said slabs also being spaced sufficiently from one another in at least part of the cavity so that they remain separated from one another under normal compression caused by a seated user;

said slabs being orientated to extend from the front to the back of the chair or the like;

at least one of the slabs in a central area of the cavity having a greater relaxed state height than the relaxed state height of said two opposed side walls, wherein the walls and slabs are juxtaposed such that at least one slab causes an outward crowning in the cushion element.

* * * * *

UNITED STATES PATENT AND TRADEMARK OFFICE

CERTIFICATE OF CORRECTION

PATENT NO. : 4,930,173

DATED : June 5, 1990

INVENTOR(S) : Thomas A. Woller

It is certified that error appears in the above—identified patent and that said Letters Patent is hereby corrected as shown below:

Col. 6, line 8 "seated riser" should be --seated user--.

Signed and Sealed this

Twenty-third Day of October, 1990

*Attest:*

HARRY F. MANBECK, JR.

*Attesting Officer*

*Commissioner of Patents and Trademarks*